US007452932B2

(12) United States Patent
Scherer et al.

(10) Patent No.: US 7,452,932 B2
(45) Date of Patent: Nov. 18, 2008

(54) HIGHLY STABLE POLYMER DISPERSIONS AND METHOD FOR THE PRODUCTION THEREOF

(75) Inventors: Markus Scherer, Lebach (DE); Alexander Dardin, Laudenbach (DE); Wolfgang Tschepat, Darmstadt (DE); Stephan Massoth, Biblis (DE)

(73) Assignee: RohMax Additives GmbH, Darmstadt (DE)

( * ) Notice: Subject to any disclaimer, the term of this patent is extended or adjusted under 35 U.S.C. 154(b) by 575 days.

(21) Appl. No.: 10/526,435

(22) PCT Filed: Aug. 27, 2003

(86) PCT No.: PCT/EP03/09464

§ 371 (c)(1),
(2), (4) Date: Mar. 3, 2005

(87) PCT Pub. No.: WO2004/037955

PCT Pub. Date: May 6, 2004

(65) Prior Publication Data

US 2005/0261143 A1 Nov. 24, 2005

(30) Foreign Application Priority Data

Oct. 22, 2002 (DE) ..... 102 49 295.6

(51) Int. Cl.
*C08K 5/10* (2006.01)
*C08K 5/06* (2006.01)

(52) U.S. Cl. ..... 524/315; 524/366; 524/376

(58) Field of Classification Search ..... 524/315, 524/366, 376

See application file for complete search history.

(56) References Cited

U.S. PATENT DOCUMENTS

| | | | | |
|---|---|---|---|---|
| 4,839,068 | A * | 6/1989 | Lange | 508/223 |
| 5,026,496 | A * | 6/1991 | Takigawa et al. | 508/472 |
| 5,130,359 | A | 7/1992 | Ohsumi et al. | |
| 2005/0148749 | A1 | 7/2005 | Scherer et al. | |
| 2005/0239937 | A1 | 10/2005 | Scherer et al. | |
| 2005/0245406 | A1 | 11/2005 | Scherer et al. | |
| 2005/0261143 | A1 | 11/2005 | Scherer et al. | |
| 2005/0267239 | A1 | 12/2005 | Scherer | |
| 2006/0189490 | A1 | 8/2006 | Dardin et al. | |

FOREIGN PATENT DOCUMENTS

| | | |
|---|---|---|
| DE | 29 05 954 | 8/1980 |
| DE | 32 07 291 | 9/1983 |
| DE | 32 07 292 | 9/1983 |

OTHER PUBLICATIONS

U.S. Appl. No. 10/593,082, filed Sep. 15, 2006, Scherer et al.
U.S. Appl. No. 10/592,363, filed Sep. 11, 2006, Scherer et al.
U.S. Appl. No. 11/587,988, filed Oct. 30, 2006, Fischer et al.
U.S. Appl. No. 11/547,612, filed Oct. 4, 2006, Scherer et al.
U.S. Appl. No. 11/572,181, filed Jan. 16, 2007, Scherer et al.
U.S. Appl. No. 11/572,330, filed Jan. 19, 2007, Acker et al.

* cited by examiner

*Primary Examiner*—Kriellion A Sanders
(74) *Attorney, Agent, or Firm*—Oblon, Spivak, McClelland, Maier & Neustadt, P.C.

(57) ABSTRACT

The present invention relates to a polymer dispersion having high stability, comprising A) at least one dispersed polyolefin,
B) at least one dispersing component,
C) mineral oil and
D) at least one compound comprising (oligo)oxyalkyl groups.

19 Claims, No Drawings

HIGHLY STABLE POLYMER DISPERSIONS AND METHOD FOR THE PRODUCTION THEREOF

The present invention relates to polymer dispersions having high stability, processes for the preparation and the use of these polymer dispersions.

Viscosity index improvers for motor oils are generally substantially hydrocarbon-based polymers. Typical addition levels in motor oils are about 0.5-6% by weight, depending on the thickening effect of the polymers. Particularly economical viscosity index improvers are olefin copolymers (OCP) which are predominantly composed of ethylene-[sic] and propylene, or hydrogenated copolymers (HSD) of dienes and styrene.

The excellent thickening effect of these polymer types must be viewed in the light of tedious processibility in the preparation of lubricating oil formulations. In particular, the poor solubility in the oils on which the formulations are based presents difficulties. Where solid polymers which have not been dissolved beforehand are used, there are therefore long periods of stirring in, the use of special stirrers and/or premilling units being necessary.

If concentrated polymers already predissolved in oil are used as customary commercial forms, only a 10-15% strength delivery form of the OCPs or HSDs can be realized. Higher concentrations are associated with excessively high actual viscosities of the solutions (>15 000 $mm^2/s$ at room temperature) and therefore can scarcely be handled. Particularly against this background, highly concentrated dispersions of olefin copolymers and hydrogenated diene/styrene copolymers were developed.

The dispersion technology described permits the preparation of polymer solutions having an OCP or HSD content of more than 20%, kinematic viscosities which permit convenient incorporation into lubricating oil formulations being obtained. In principle, the synthesis of such systems comprises the use of a so-called emulsifier or of a dispersing component. Customary dispersing components are, inter alia, OCP or HSD polymers onto which alkyl methacrylates or alkyl methacrylate/styrene mixtures have generally been grafted. Dispersions in which a solvent which dissolves the methacrylate component of the dispersion better and the OCP or HSD fraction more poorly is used are also known. Such a solvent together with the methacrylate fraction of the product forms the main component of the continuous phase of the dispersion. Formally, the OCP or HSD fraction is the main component of the discontinuous or disperse phase.

Inter alia, the following documents are regarded as prior art:

U.S. Pat. No. 4,149,984
EP-A-0 008 327
DE 32 07 291
DE 32 07 292

U.S. Pat. No. 4,149,984 describes a process for the preparation of lubricating oil additives by improving the compatibility between polyalkyl methacrylates, referred to below as PAMA, and polyolefins. The amount by weight of the PAMA is 50-80% by weight and that of the polyolefin is 20-50%. The total polymer content of the dispersion is 20-55%. The use of dispersing monomers, such as N-vinylpyrrolidone, for grafting is also mentioned. Before this application, it was known that methacrylates can be polymerized onto a polyolefin by grafting (DT-AS 1 235 491).

EP-A-0 008 327 protects the process for the preparation of lubricating oil additives based on a hydrogenated block copolymer of conjugated dienes and styrene, styrene and alkyl methacrylates or exclusively alkyl methacrylates being grafted onto the hydrogenated block copolymer in the first stage and an additional graft (e.g. N-vinylpyrrolidone) is built up in the second stage. The amount of the hydrogenated block copolymer, based on the total polymer content, is 5-55% by weight, that of the first graft consisting of PAMA/styrene is 49.5-85% and that of the second graft is 0.5-10%.

The document DE 32 07 291 describes processes which permit increased incorporation of olefin copolymer. The olefin copolymer content is said to be 20-65% in relation to the total weight of the dispersion. The subject of the invention is that more highly concentrated dispersions are obtained by using suitable solvents which dissolve olefin copolymers poorly and PAMA-containing components well. DE 32 07 291 is to be understood as being a process patent which describes in particular the preparation of the dispersions.

DE 32 07 292 substantially corresponds to DE 32 07 291 but should rather be understood as protecting certain copolymer compositions. These compositions are prepared by a process analogous to that described in DE 32 07 291.

The polymer dispersions described in the prior art already have a good property profile. However, particularly their stability is worthy of improvement. It should be considered here that polymer dispersions have to be stored over long periods without cooling apparatuses generally being used. The storage time includes in particular the transport, etc., temperatures above 40° C. or even 50° C. occurring.

In addition, it was an object of the present invention to provide polymer dispersions having a low viscosity in combination with a high polyolefin content. The higher the content of OCP or HSD, the higher in general is the viscosity of the dispersion. On the other hand, a high content of these polymers is desirable in order to reduce the transport costs. It should be considered here that a lower viscosity permits easier and faster mixing of the viscosity index improvers into the base oil. It was therefore intended to provide polymer dispersions which have a particularly low viscosity.

In addition, the processes for the preparation of the above-mentioned polymer dispersions are relatively difficult to control, so that certain specifications can be complied with only with very great difficulty. Accordingly, it was intended to provide polymer dispersions whose viscosity can be easily adjusted to predetermined values.

A further object was to provide polymer dispersions which have a high content of polyolefins, in particular of olefin copolymers and/or of hydrogenated block copolymers.

Furthermore, the polymer dispersions should be capable of being prepared easily and economically, it being intended in particular to use commercially available components. The production should be capable of being carried out on an industrial scale without new plants or plants of complicated design being required for this purpose.

These and further objects which are not explicitly mentioned but which can be readily derived are concluded from the relationships discussed herein at the outset are achieved by polymer dispersions having all the features of Patent Claim 1. Expedient modifications of the polymer dispersions according to the invention are protected in the subclaims relating back to Claim 1. Regarding the process for the preparation of polymer dispersions, Claim 17 provides an achievement of the underlying object, while Claim 18 protects a preferred use of a polymer dispersions [sic] of the present invention.

Because polymer dispersions comprise

A) at least one dispersed polyolefin,
B) at least one dispersing component,
C) mineral oil and D) at least one compound comprising (oligo)oxyalkyl groups, it is possible to provide, in a manner not directly foreseeable, polymer dispersions which have particularly high stability.

At the same time, a number of further advantages can be achieved by the polymer dispersions according to the invention. These include inter alia:

The polymer dispersions according to the invention may comprise particularly large amounts of polyolefins which have a viscosity index-improving or, in lubricating oils, a thickening effect.

The polymer dispersions of the present invention can be adjusted in a particularly simple manner to a predetermined viscosity.

Polymer dispersions according to the subject of the present invention have a low viscosity.

The preparation of the polymer dispersions of the present invention can be prepared [sic] in a particularly easy and simple manner. Customary, industrial plants can be used for this purpose.

The Component A)

The polymer dispersion comprises, as a component essential to the invention, polyolefins which preferably have a viscosity index-improving or thickening effect. Such polyolefins have long been known and are described in the documents mentioned in the prior art.

These polyolefins include in particular polyolefin copolymers (OCP) and hydrogenated styrene/diene copolymers (HSD).

The polyolefin copolymers (OCP) to be used according to the invention are known per se. They are primarily polymers synthesized from ethylene-, propylene-, isoprene-, butylene-[sic] and/or further -olefins [sic] having 5 to 20 C atoms, as are already recommended as VI improvers. Systems which have been grafted with small amounts of oxygen- or nitrogen-containing monomers (e.g. from 0.05 to 5% by weight of maleic anhydride) may also be used. The copolymers which contain diene components are generally hydrogenated in order to reduce the oxidation sensitivity and the crosslinking tendency of the viscosity index improvers.

The molecular weight Mw is in general from 10 000 to 300 000, preferably between 50 000 and 150 000. Such olefin copolymers are described, for example, in the German Laid-Open Applications DE-A 16 44 941, DE-A 17 69 834, DE-A 19 39 037, DE-A 19 63 039 and DE-A 20 59 981.

Ethylene/propylene copolymers are particularly useful and terpolymers having the known ternary components, such as ethylidene-norbornene (cf. Macromolecular Reviews, Vol. 10 (1975)) are also possible, but their tendency to crosslink must also be taken into account in the aging process. The distribution may be substantially random, but sequential polymers comprising ethylene blocks can also advantageously be used. The ratio of the monomers ethylene/propylene is variable within certain limits, which can be set to about 75% for ethylene and about 80% for propylene as an upper limit. Owing to its reduced tendency to dissolve in oil, polypropylene is less suitable than ethylene/propylene copolymers. In addition to polymers having a predominantly atactic propylene incorporation, those having a more pronounced isotactic or syndiotactic propylene incorporation may also be used.

Such products are commercially available, for example under the trade names Dutral® CO 034, Dutral® CO 038, Dutral® CO 043, Dutral® CO 058, Buna® EPG 2050 or Buna® EPG 5050.

The hydrogenated styrene/diene copolymers (HSD) are likewise known, these polymers being described, for example, in DE 21 56 122. They are in general hydrogenated isoprene/styrene or butadiene/styrene copolymers. The ratio of diene to styrene is preferably in the range from 2:1 to 1:2, particularly preferably about 55:45. The molecular weight Mw is in general from 10 000 to 300 000, preferably between 50 00 and 150 000. According to a particular aspect of the present invention, the proportion of double bonds after the hydrogenation is not more than 15%, particularly preferably not more than 5%, based on the number of double bonds before the hydrogenation.

Hydrogenated styrene/diene copolymers can be commercially obtained under the trade name ®SHELLVIS 50, 150, 200, 250 or 260.

In general, the amount of components A) is at least 20% by weight, preferably at least 30% by weight and particularly preferably at least 40% by weight, without there being any intention to impose a restriction hereby.

The Component B)

The component B) is formed from at least one dispersing component, it being possible for this component frequently to be regarded as block copolymers. Preferably, at least one of these blocks has high compatibility with the previously described polyolefins of components A), at least one further block of the blocks contained in the dispersing components having only low compatibility with the previously described polyolefins. Such dispersing components are known per se, preferred compounds being described in the abovementioned prior art.

The radical compatible with components A) generally has a nonpolar character whereas the incompatible radical is of a polar nature. According to a particular aspect of the present invention, preferred dispersing components may be considered as block copolymers which comprise one or more blocks A and one or more blocks X, the block A representing olefin copolymer sequences, hydrogenated polyisoprene sequences, hydrogenated copolymers of butadiene/isoprene or hydrogenated copolymers of butadiene/isoprene and styrene and the block X representing polyacrylate-, polymethacrylate-, styrene-, α-methylstyrene or N-vinyl-heterocyclic sequences or sequences comprising mixtures of polyacrylate-, polymethacrylate-, styrene-, α-methylstyrene or N-vinyl-heterocycles.

Preferred dispersing components can be prepared by graft polymerization, polar monomers being grafted onto the polyolefins described above, in particular onto the OCP and HSD. For this purpose, the polyolefins can be pretreated by mechanical and/or thermal degradation.

The polar monomers include in particular (meth)acrylates and styrene compounds.

The expression (meth)acrylates includes methacrylates and acrylates and mixtures of the two.

According to a particular aspect of the present invention, a monomer composition comprising one or more (meth)acrylates of the formula (I)

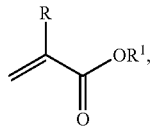

(I)

in which R denotes hydrogen or methyl and $R^1$ denotes hydrogen or a linear or branched alkyl radical having 1 to 40 carbon atoms, is used in the grafting reaction.

The preferred monomers according to formula (I) include, inter alia, (meth)acrylates which are derived from saturated alcohols, such as methyl(meth)acrylate, ethyl (meth)acrylate, n-propyl (meth)acrylate, isopropyl (meth)acrylate, n-butyl (meth)acrylate, tert-butyl (meth)acrylate, pentyl (meth)acrylate, hexyl (meth)acrylate, 2-ethylhexyl (meth)acrylate, heptyl (meth)acrylate, 2-tert-butylheptyl (meth)acrylate, octyl (meth)acrylate, 3-isopropylheptyl (meth)acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth) acrylate, pentadecyl (meth)acrylate, hexadecyl (meth) acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth) acrylate, cetyleicosyl (meth)acrylate, stearyleicosyl (meth) acrylate, docosyl (meth)acrylate and/or eicosyltetratriacontyl (meth)acrylate; (meth)acrylates which are derived from unsaturated alcohols, such as, for example, 2-propynyl (meth)acrylate, allyl (meth)acrylate, vinyl (meth)acrylate, oleyl (meth)acrylate; cycloalkyl (meth)acrylates, such as cyclopentyl (meth)acrylate, 3-vinylcyclohexyl (meth)acrylate, cyclohexyl (meth)acrylate, bornyl (meth)acrylate.

Furthermore, the monomer composition may comprise one or more (meth)acrylates of the formula (II)

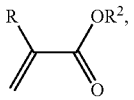

(II)

in which R denotes hydrogen or methyl and $R^2$ denotes an alkyl radical substituted by an OH group and having 2 to 20 carbon atoms or denotes an alkoxylated radical of the formula (III)

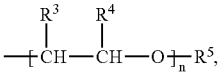

(III)

in which $R^3$ and $R^4$ independently represent hydrogen or methyl, $R^5$ represents hydrogen or an alkyl radical having 1 to 40 carbon atoms and n represents an integer from 1 to 90. [sic]

(Meth)acrylates according to formula (III) are known to a person skilled in the art. These include, inter alia, hydroxyalkyl (meth)acrylates, such as 3-hydroxypropyl methacrylate, 3,4-dihydroxybutyl methacrylate, 2-hydroxyethyl methacrylate, 2-hydroxypropyl methacrylate, 2,5-dimethyl-1,6-hexanediol (meth)acrylate, 1,10-decanediol (meth)acrylate, 1,2-propanediol (meth)acrylate;

polyoxyethylene and polyoxypropylene derivatives of (meth) acrylic acid, such as triethylene glycol (meth)acrylate, tetraethylene glycol (meth)acrylate and tetrapropylene glycol (meth)acrylate.

The (meth)acrylates having a long-chain alcohol radical can be obtained, for example, by reacting the corresponding acids and/or short-chain(meth)acrylates, in particular methyl (meth)acrylate or ethyl (meth)acrylate, with long-chain fatty alcohols, in general a mixture of esters, such as, for example, (meth)acrylates having different long-chain alcohol radicals, being formed. These fatty alcohols include, inter alia, Oxo AlcoholÒ 7911 and Oxo AlcoholÒ 7900, Oxo AlcoholÒ 1100 from Monsanto; AlphanolÒ 79 from ICI; NafolÒ 1620, AlfolÒ 610 and AlfolÒ 810 from Condea; EpalÒ 610 and EpalÒ 810 from Ethyl Corporation; LinevolÒ 79, LinevolÒ 911 and DobanolÒ 25L from Shell AG; Lial 125 from AugustaÒ Milan; DehydadÒ and LorolÒ from Henkel KGaA and LinopolÒ 7-11 and AcropolÒ 91 Ugine Kuhlmann [sic].

and/or [sic] one or more (meth)acrylates of the formula (IV)

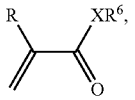

(IV)

in which R denotes hydrogen or methyl, X denotes oxygen or an amino group of the formula —NH— or —$NR^7$—, in which $R^7$ represents an alkyl radical having 1 to 40 carbon atoms, and $R^6$ denotes a linear or branched alkyl radical substituted by at least one —$NR^8R^9$ group and having 2 to 20, preferably 2 to 6, carbon atoms, $R^8$ and $R^9$, independently of one another, representing hydrogen or an alkyl radical having 1 to 20, preferably 1 to 6 [lacuna], or in which $R^8$ and $R^9$, including the nitrogen atom and optionally a further nitrogen or oxygen atom, forming a 5- or 6-membered ring which optionally may be substituted by $C_1$-$C_6$-alkyl.

The (meth)acrylates or the (meth)acrylamides according to formula (IV) include, inter alia, amides of (meth)acrylic acid, such as N-(3-dimethylaminopropyl)methacrylamide, N-(diethylphosphono)methacrylamide, 1-methacryloylamido-2-methyl-2-propanol, N-(3-dibutylaminopropyl)methacrylamide, N-tert-butyl-N-(diethylphosphono)methacrylamide, N,N-bis(2-diethylaminoethyl)methacrylamide, 4-methacryloylamido-4-methyl-2-pentanol, N-(methoxymethyl)methacrylamide, N-(2-hydroxyethyl)methacrylamide;

N-acetylmethacrylamide,

N-(dimethylaminoethyl)methacrylamide,

N-methyl-N-phenylmethacrylamide,

N,N-diethylmethacrylamide,

N-methylmethacrylamide,

N,N-dimethylmethacrylamide,

N-isopropylmethacrylamide;

aminoalkyl methacrylates, such as tris(2-methyacryloyloxyethyl)amine,

N-methylformamidoethyl methacrylate, 2-ureidoethyl methacrylate;

heterocyclic (meth)acrylates, such as 2-(1-imidazolyl)-ethyl (meth)acrylate, 2-(4-morpholinyl)ethyl-(meth)acrylate and 1-(2-methacryloyloxyethyl)-2-pyrrolidone.

Furthermore, the monomer composition may comprise styrene compounds. These include, inter alia, styrene, substituted styrenes having an alkyl substituent in the side chain, such as, for example, α-methylstyrene and α-ethylstyrene, substituted styrenes having an alkyl substituent on the ring, such as vinyltoluene and p-methylstyrene, halogenated styrenes, such as, for example, monochlorostyrenes, dichlorostyrenes, tribromostyrenes and tetrabromostyrenes.

In addition, the monomer compositions may comprise heterocyclic vinyl compounds, such as 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles.

In addition to styrene compounds and (meth)acrylates, particularly preferred monomers are monomers which have dispersing effects, such as, for example, the abovementioned heterocyclic vinyl compounds. These monomers are furthermore designated as dispersing monomers.

The abovementioned ethylenically unsaturated monomers may be used individually or as mixtures. It is furthermore possible to vary the monomer composition during the polymerization.

The weight ratio of the parts of the dispersing component which are compatible with the polyolefins, in particular of the blocks A, to the parts of the dispersing component which are incompatible with the polyolefins, in particular the blocks X, may be within wide ranges. In general, this ratio is in the range from 50:1 to 1:50, in particular from 20:1 to 1:20 and particularly preferably from 10:1 to 1:10.

The preparation of the dispersing components described above is known to those skilled in the art. For example, the preparation can be effected via a polymerization in solution. Such processes are described, inter alia, in DE-A 12 35 491, BE-A 592 880, U.S. Pat. Nos. 4,281,081, 4,338,418 and 4,290,025.

For this purpose, a mixture of the OCP and one or more of the monomers described above can be initially introduced into a suitable reaction vessel, expediently equipped with stirrer, thermometer, reflux condenser and metering line.

After dissolution under an inert atmosphere, such as, for example, nitrogen, with heating, for example to 110° C., a proportion of a customary free radical initiator, for example from the group consisting of the peresters, is prepared, initially, for example, about 0.7% by weight, based on the monomers.

Thereafter, a mixture of the remaining monomers is metered over a few hours, for example 3.5 hours, with addition of further initator [sic], for example about 1.3% by weight, based on the monomers. A little more initiator is expediently fed sometime after the end of the addition, for example after two hours. The total duration of the polymerization can be taken as a guide value, for example with about 8 hours [sic]. After the end of the polymerization, dilution is expediently effected with a suitable solvent, such as, for example, a phthalic ester, such as dibutyl phthalate. As a rule, a virtually clear, viscous solution is obtained.

Furthermore, the preparation of the polymer dispersion can be effected in a kneader, an extruder or a static mixer. As a result of the treatment in the apparatus, a decrease in the molecular weight of the polyolefin, in particular of the OCP or HSD, occurs under the influence of the shear forces, of the temperature and of the initiator concentration.

Examples of initiators suitable for the graft copolymerization are cumyl hydroperoxide, diumyl [sic] peroxide, benzoyl peroxide, azobisisobutyronitrile, 2,2-bis(tert-butylperoxy) butane, diethyl peroxy-dicarbonate and tert-butyl peroxide. The processing temperature is between 80° C. and 350° C. The residence time in the kneader or extruder is between 1 minute and 10 hours.

The longer the dispersion is treated in the kneader or extruder, the lower will be the molecular weight. The temperature and the concentration of free radical initiators can be adjusted according to the desired molecular weight. By incorporation into suitable carrier media, the solvent-free polymer-in-polymer dispersion can be converted into a liquid polymer/polymer emulsion which is easy to handle.

The amount of components B) is in general up to 30% by weight, and in particular this amount is in the range from 5 to 15% by weight, without there being any intention to impose a restriction hereby. The use of larger amounts of component B) is frequently uneconomical. Smaller amounts often lead to lower stability of the polymer dispersion.

The Component C)

The component C) is essential for the success of the present invention. Mineral oils are known per se and are commercially available. They are obtained in general from petroleum or crude oil by distillation and/or refining and optionally further purification and treatment processes, the term mineral oil covering in particular the relatively high-boiling fractions of the crude oil or petroleum. In general, the boiling point of mineral oil is higher than 200° C., preferably higher than 300° C., at 5 000 Pa. The preparation by low-temperature carbonization of shale oil, coking of coal, distillation of lignite in the absence of air and hydrogenation of coal or lignite is likewise possible. To a small extent, mineral oils are also prepared from raw materials of vegetable (e.g. from jojoba, rape) or animal (e.g. neatsfoot oil) origin. Accordingly, depending on origin, mineral oils have different fractions of aromatic, cyclic, branched and linear hydrocarbons.

In general, a distinction is made between paraffin-based, naphthenic and aromatic fractions in crude oils or mineral oils, the terms paraffin-based fraction representing relatively long-chain or highly branched isoalkanes and naphthenic fraction representing cycloalkanes. Moreover, depending on origin and treatment, mineral oils have different fractions of n-alkanes, isoalkanes having a low degree of branching, so-called monomethyl-branched paraffins, and compounds having heteroatoms, in particular O, N and/or S, to which polar properties are attributed to a limited extent. The assignment is however difficult since individual alkane molecules may have both long-chain branched groups and cycloalkane radicals and aromatic moieties. For the purposes of the present invention, the assignment can be made, for example, according to DIN 51 378. Polar moieties can also be determined according to ASTM D 2007.

The fraction of the n-alkanes in preferred mineral oils is less than 3% by weight, and the fraction of O, N and/or S-containing compounds is less than 6% by weight. The fraction of aromatics and of monomethyl-branched paraffins is in general in each case in the range from 0 to 40% by weight. According to an interesting aspect, mineral oil mainly comprises naphthenic and paraffin-based alkanes, which in general have more than 13, preferably more than 18 and very particularly preferably more than 20, carbon atoms. The fraction of these compounds is in general ≧60% by weight, preferably ≧80% by weight, without there being any intention to impose any restriction hereby. A preferred mineral oil contains from 0.5 to 30% by weight of aromatic fractions, from 15 to 40% by weight of naphthenic fractions, from 35 to 80% by weight of paraffin-based fractions, up to 3% by weight of n-alkanes and from 0.05 to 5% by weight of polar compounds, based in each case on the total weight of the mineral oil.

An analysis of particularly preferred mineral oils which was carried out by means of conventional methods, such as urea separation and liquid chromatography over silica gel, shows, for example, the following components, the stated percentages being based on the total weight of the mineral oil used in each case:

n-alkanes having about 18 to 31 C atoms:
0.7-1.0%, alkanes having 18 to 31 C atoms and a low degree of branching:
1.0-8.0%, aromatics having 14 to 32 C atoms:
0.4-10.7%, iso- and cycloalkanes having 20 to 32 C atoms:
60.7-82.4%, and polar compounds:
0.1-0.8%, loss:
6.9-19.4%.

Valuable information with respect to the analysis of mineral oils and a list of mineral oils which have a differing composition are to be found, for example, in Ullmann's Encyclopedia of Industrial Chemistry, 5$^{th}$ Edition on CD-ROM, 1997, key word "lubricants and related products".

According to a particular aspect of the present invention, the polymer dispersion contains preferably from 2 to 40% by weight, in particular from 5 to 30% by weight and particularly preferably from 10 to 20% by weight of mineral oil.

The Component D)

The component D) is obligatory for the present polymer dispersion, this component containing one or more compound [sic] comprising at least one (oligo)oxyalkyl groups [sic]. In general, the compounds according to component D) comprise preferably from 1 to 40, in particular from 1 to 20 and particularly preferably from 2 to 8 oxyalkyl groups.

The oxyalkyl groups are in general of the formula (V)

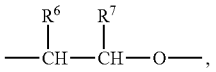

(V)

in which $R^6$ and $R^7$ independently represent hydrogen or an alkyl radical having 1 to 10 carbon atoms.

The oxyalkyl groups include in particular the ethoxy, the propoxy and the butoxy groups, the ethoxy groups being preferred.

These include in particular esters and ethers which have the abovementioned groups.

In the group consisting of the esters, the following may be singled out: phosphoric esters, esters of monocarboxylic acids and esters of dicarboxylic acids. (cf. Ullmanns Encyclopädie der Technischen Chemie, [Ullmann's Encyclopedia of Industrial Chemistry] 3rd Edition, vol. 15, pages 287-292, Urban & Schwarzenber [sic] (1964)).

Propanoic acid, (iso)butyric acid and pelargonic acid may be mentioned specifically as monocarboxylic acids.

Suitable esters of dicarboxylic acids are the esters of phthalic acid and also the esters of aliphatic dicarboxylic acids, particularly the esters of straight-chain dicarboxylic acids. The esters of sebacic, of adipic and of azelaic acid may be singled out in particular.

The diesters with diethylene glycol, triethylene glycol, tetraethylene glycol to decamethylene glycol and furthermore with dipropylene glycol as alcohol components may be singled out as esters of monocarboxylic acids with diols or polyalkylene glycols. Propionic acid, (iso)butyric acid and pelargonic acid may be specifically mentioned as monocarboxylic acids—for example dipropylene glycol dipelargonate, diethylene glycol dipropionate—and diisobutyrate [sic] and the corresponding esters of triethylene glycol, and tetraethylene glycol di-2-ethylhexanoate may be mentioned.

These esters can be used individually or as a mixture.

Furthermore, the compounds according to component D) include ether compounds which have (oligo)alkoxy groups. These include in particular ethoxylated alcohols which have particularly preferably 1 to 20, in particular 2 to 8 ethoxy groups.

The hydrophobic radical of the ethoxylated alcohols comprises preferably from 1 to 40, preferably [sic] from 4 to 22, carbon atoms, it being possible to use both linear and branched alkyl radicals. Oxo alcohol ethoxylates may also be used.

The preferred hydrophobic radicals of these ethers include, inter alia, the methyl, ethyl, propyl, butyl, pentyl, 2-methylbutyl, pentenyl, cyclohexyl, heptyl, 2-methylheptenyl, 3-methylheptyl, octyl, nonyl, 3-ethylnonyl, decyl, undecyl, 4-propenylundecyl, dodecyl, tridecyl, tetradecyl, pentadecyl, hexadecyl, heptadecyl, octadecyl, nonadecyl, eicosyl, cetyleicosyl, docosyl and/or eicosyltetratriacontyl group.

Examples of commercial ethoxylates which can be used for the preparation of the concentrates according to the invention are ethers of Lutensol® A grades, in particular Lutensol® A 3 N, Lutensol® A 4 N, Lutensol® A 7 N and Lutensol® A 8 N, ethers of Lutensol® TO grades, in particular Lutensol® TO 2, Lutensol® TO 3, Lutensol® TO 5, Lutensol® TO 6, Lutensol® TO 65, Lutensol® TO 69, Lutensol® TO 7, Lutensol® TO 79, Lutensol® 8 and Lutensol® 89, ethers of Lutensol® AO grades, in particular Lutensol® AO 3, Lutensol® AO 4, Lutensol® AO 5, Lutensol® AO 6, Lutensol® AO 7, Lutensol® AO 79, Lutensol® AO 8 and Lutensol® AO 89, ethers of Lutensol® ON grades, in particular Lutensol® ON 30, Lutensol® ON 50, Lutensol® ON 60, Lutensol® ON 65, Lutensol® ON 66, Lutensol® ON 70, Lutensol® ON 79 and Lutensol® ON 80, ethers of Lutensol® XL grades, in particular Lutensol® XL 300, Lutensol® XL 400, Lutensol® XL 500, Lutensol® XL 600, Lutensol® XL 700, Lutensol® XL 800, Lutensol® XL 900 and Lutensol® XL 1000, ethers of Lutensol® AP grades, in particular Lutensol® AP 6, Lutensol® AP 7, Lutensol® AP 8, Lutensol® AP 9, Lutensol® AP 10, Lutensol® AP 14 and Lutensol® AP 20, ethers of IMBENTIN® grades, in particular of IMBENTIN® AG grades, of IMBENTIN® U grades, of IMBENTIN® C grades, of IMBENTIN® T grades, of IMBENTIN® OA grades, of IMBENTIN® POA grades, of IMBENTIN® N grades and of IMBENTIN® O grades and ethers of Marlipal® grades, in particular Marlipal® 1/7, Marlipal® 1012/6, Marlipal® 1618/1, Marlipal® 24/20, Marlipal® 24/30, Marlipal® 24/40, Marlipal® O13/20, Marlipal® O13/30, Marlipal® O13/40, Marlipal® O25/30, Marlipal® O25/70, Marlipal® O45/30, Marlipal® O45/40, Marlipal® O45/50, Marlipal® O45/70 and Marlipal® 045/80.

These ethers may be used individually or as a mixture.

According to a particular aspect of the present invention, the polymer dispersion contains preferably from 2 to 55% by weight, in particular from 5 to 45% by weight and particularly preferably from 10 to 40% by weight of compounds which comprise (oligo)oxyalkyl groups.

The weight ratio of mineral oil to compounds having (oligo)oxyalkyl groups can be in wide ranges. Particularly preferably this ratio is in the range from 2:1 to 1:25, in particular from 1:1 to 1:15.

The amount of the components C) and D), based on the concentrated polymer dispersion, may be within wide ranges, this amount being dependent in particular on the polyolefins and dispersing components used. In general, the amount of the components C) and D) together is from 79 to 25% by weight, preferably less than 70, especially from 60 to 40, % by weight, based on the total polymer dispersion.

In addition to the abovementioned components, the polymer dispersion according to the invention may contain further additives and admixed substances.

In particular, further carrier media can therefore be used in the polymer dispersion. The solvents which can be used as a liquid carrier medium should be inert and on the whole safe. Carrier media which fulfil said conditions belong, for example, to the group consisting of the esters, ethers and/or to the group consisting of the higher alcohols. As a rule the molecules of the types of compound which are suitable as a carrier medium contain more than 8 carbon atoms per molecule.

It should be mentioned that mixtures of the solvents described above are also suitable for the carrier medium.

The following are singled out in the group consisting of the esters: phosophoric esters, esters of dicarboxylic acids, esters of monocarboxylic acids with diols or polyalkylene glycols, esters of neopentylpolyols with monocarboxylic acids (cf. Ullmanns Encyclopädie der Technischen Chemie [Ullmann's Encyclopaedia of Industrial Chemistry], 3rd Edition, vol. 15, pages 287-292, Urban & Schwarzenber [sic] (1964)). Typical esters of dicarboxylic acids are the esters of phthalic acid, in particular phthalic esters with $C_4$ to $C_8$-alchols, dibutyl phthalate and dioctyl phthalate being mentioned in particular, and also the esters of aliphatic dicarboxylic acids, in particular esters of straight-chain dicarboxylic acids with branched primary alcohols. The esters of sebacic, of adipic and of azelaic acid are singled out in particular; in particular the 2-ethylhexyl and isooctyl-3,5,5-trimethyl esters and the esters with $C_8$-, $C_9$- or $C_{10}$-oxo alcohols should be mentioned.

The esters of straight-chain primary alcohols with branched dicarboxylic acids are particularly important. Alkyl-substituted adipic acid may be mentioned as examples, for example 2,2,4-trimethyladipic acid.

Preferred carrier media are further nonionic surfactants. These include, inter alia, fatty acid polyglycol esters, fatty amine polyglycol ethers, alkypolyglycosides, fatty amine N-oxides and long-chain alkyl sulfoxides.

Furthermore, the polymer dispersion of the present invention may comprise compounds having a dielectric constant greater than or equal to 9, in particular greater than or equal to 20 and particularly preferably greater than or equal to 30. Surprisingly, it was found that the viscosity of the polymer dispersion can be reduced by adding these compounds. It is possible thereby in particular to adjust the viscosity to a predetermined value.

The dielectric constant can be determined by methods stated in Handbook of Chemistry and Physics, David R. Lide, 79th Edition, CRS Press, the dielectric constant being measured at 20° C.

The particularly suitable compounds include, inter alia, water, glycols, in particular ethylene glycol, 1,2-propylene glycol, 1,3-propylene glycol, polyethylene glycol; alcohols, in particular methanol, ethanol, butanol, glycerol; ethoxylated alcohols, for example diethoxylated butanol, decaethoxylated methanol; amines, in particular ethanolamine, 1,2 ethanediamine [sic] and propanolamine; halogenated hydrocarbons, in particular 2-chloroethanol, 1,2 dichloroethane [sic], 1,1 dichloroacetone [sic]; ketones, in particular acetone.

The proportion of the compounds described above in the polymer dispersion may be within wide ranges. In general, the polymer dispersion comprises up to 15% by weight, in particular from 0.3 to 5% by weight, of compounds having a dielectric constant greater than or equal to 9.

The polymer dispersions can be prepared by known processes, these processes being described in the abovementioned documents of the prior art. Thus, for example, the present polymer dispersions can be prepared by dispersing component A) in a solution of components B) with application of shear forces at a temperature in the range of from 80 to 180° C. The solution of components B) comprises in general components C) and D). These components can be added to the dispersion before, during or after the dispersing of components A).

The invention is explained in more detail below by examples and comparative examples, without it being intended to restrict the invention to these examples.

Methods Used

Below, KV100 means the kinematic viscosity of a liquid, measured at 100° C. in a 150N oil. The determination of the viscosity is carried out according to DIN 51 562 (Ubbelohde viscometer). Here, the concentration of the OCP in oil is in each case 2.8% by weight. The data BV20, BV40 and BV100 designate the kinematic viscosities of the dispersions (BV="bulk viscosity"), likewise measured according to DIN 51 562 (Ubbelohde viscometer) at 20, 40 and 100° C., respectively.

Initiators used for the preparation of the dispersions were conventional members, such as, for example, the per initiators di(tert-butylperoxy)-3,3,5-trimethyl-cyclohexane and/or tert-butyl peroctanoate.

For testing the stability of a dispersion, 670 g of the product can be weighed into a 2 liter Witt pot. An Inter-Mig stirrer having three paddles (measuring stirrer with torque and speed indication MR-D1 from Ika) and an NiCrNi thermocouple (temperature controller 810 from Eurotherm) are installed in the Witt pot. The oil bath (silicone oil PN 200) is heated up, the speed being adjusted so that a power of 3.1 watt is introduced. The power introduced can be calculated via the viscosity.

The product is heated to 160° C. and this internal temperature is then maintained for 2 h. Thereafter, the internal temperature in the reactor is increased by 10° C. in the course of 15 minutes and once again maintained for 2 h, this procedure being repeated several times until the internal temperature is 190° C. If the product undergoes phase separation beforehand, which is evident from an abrupt increase in the viscosity and hence from a rapid increase in the torque, the experiment is terminated. The time and temperature at this point in time are detected.

EXAMPLE 1

In a 2 liter four-necked flask equipped with stirrer, thermometer and reflux condenser, 70.3 g of an ethylene/propylene copolymer having a thickening effect of 11.0 $mm^2/s$ with respect to KV100 (e.g. thermally or mechanically degraded Dutral® CO 038) are weighed into a mixture consisting of 251.8 g of a 150N oil and 47.9 g of a 100N oil and dissolved at 100° C. in the course of 10-12 hours. After the dissolution process 41.1 g of a mixture consisting of alkyl methacrylates having alkyl substituents of chain length C10-C18 are added and the reaction mixture is rendered inert by adding dry ice. After the polymerization temperature of 130° C. has been reached, 0.52 g of 1,1-di(tert-butylperoxy)-3,3,5-trimethylcyclohexane is added and at the same time, a monomer feed consisting of 588.9 g of the analogous composition as above and 7.66 g of 1,1-di(tert-butylperoxy)-3,3,5-trimethylcyclohexane is started and is introduced uniformly over a feed time of 3.5 hours. 2 hours after the end of the feed, the mixture is diluted to a polymer content of 47.55% with 472.1 g of an ethoxylated fatty alcohol (e.g. Marlipal® O13/20). At the same time, the temperature is reduced to 100° C., 1.26 g of tert-butyl peroctanoate are added and stirring is carried out for a further 2 hours at 100° C. 286.2 g of the prepared solution, 43.2 g of an ethylene/propylene copolymer (e.g. Dutral® CO 038 degraded to 11.5 $mm^2/s$) and 170.6 g of a further ethylene/propylene copolymer (e.g. Dutral® CO 058 degraded to a KV100 of 11.5 $mm^2/s$) are weighed into a 1 liter Witt pan equipped with an Inter-Mig stirrer (ratio of stirrer/container diameter=0.7; stirrer speed set: 150 rpm). A brownish dispersion forms in the course of 8-10 hours at 100° C. and 150 rpm stirrer speed, said dispersion tending to separate out the ethylene/propylene copolymers within a few weeks at room temperature. For stabilization, the temperature is therefore increased from 100° C. to 140° C. and stirring is continued at 150 rpm for 6 hours. Thereafter, dilution to polymer content 55% is effected by diluting with 136.6 g of an ethoxylated fatty alcohol (e.g. Marlipal® O13/20) and the mixture is stirred for a further half hour at 100° C. The KV100 of the product thus prepared is 3488 $mm^2/s$. The KV100 of a 2.8% strength solution of the product in a 150N oil is 11.43 $mm^2/s$.

The dispersion obtained was subjected to the stability test described above, phase separation occurring and the viscosity increasing abruptly after about 420 min when a temperature of 180° C. has been reached.

COMPARATIVE EXAMPLE 1

78.0 g of an ethylene/propylene copolymer having a thickening effect of 11.0 $mm^2/s$ with respect to its KV100 (e.g. corresponding to degraded Dutral® CO 043) are dissolved in 442.1 g of dioctyl adipate at 100° C. in the course of 10-12 hours in a 2 liter four-necked flask equipped with stirrer, thermometer and reflux condenser. Thereafter, 57.8 g of a mixture consisting of alkyl methacrylates having alkyl substituents of chain length C10-C18 are added. The reaction mixture is rendered inert by adding dry ice. After the temperature of the solution has been increased to 110° C., 0.57 g of tert-butyl peroctanoate are added and at the same time a feed consisting of 422.1 g of alkyl methacrylates of a composition analogous to that above and 8.44 g of tert-butyl peroctanoate is started. The total feed time is 3.5 hours and a constant metering rate is maintained during this time. 2 hours after the end of the feed, 0.96 g of tert-butyl peroctanoate is added. After 3-4 hours, a solution which is subsequently used as a dispersing component is obtained. Dilution to a polymer content of 35.1% is then effected with 589.9 g of dibutyl phthalate. 306.4 g of the solution thus prepared are weighed into a 1 liter Witt pan equipped with an Inter-Mig stirrer (ratio stirrer/container diameter=0.7 stirrer speed set: 150 rpm) together with two different ethylene/propylene copolymers (e.g 96.8 g of Dutral® CO 038 degraded to a KV100 of 11.5 $mm^2/s$ and 96.8 g of Dutral® CO 058 degraded to a KV100 of 11.5 $mm^2/s$). After the temperature has been increased to 100° C. and stirring effected at a speed of 150 rpm, a brownish dispersion forms in the course of 8-10 hours. This is further stirred at 150 rpm for 6 hours, with the result that a more stable dispersion is obtained (evident from a reduced tendency to separate out pure ethylene/propylene copolymers). Thereafter, 500 g of this batch are diluted to 55% polymer content by adding 73.1 g of the 47.55% strength dispersing component described and 20.8 g of dibutyl phthalate. Stirring is then continued for a futher half hour at 150 rpm. The KV100 of the product thus prepared is 1524 $mm^2/s$. The KV100 of a 2.8% strength solution of the product in a 150N oil is 11.43 $mm^2/s$.

The dispersion obtained was subjected to the stability test described above, phase separation occurring and the viscosity increasing abruptly after about 250 min once a temperature of 170° C. has been reached.

The invention claimed is:

1. A polymer dispersion having high stability, comprising

A) at least one dispersed polyolefin,

B) at least one dispersing component,

C) mineral oil and

D) at least one compound comprising (oligo)oxyalkyl groups, wherein the component D) comprises at least one ethoxylated alcohol, and the ethoxylated alcohol comprises from 2 to 8 ethoxy groups and the hydrophobic radical of the alcohol comprises from 4 to 22 carbon atoms.

2. The polymer dispersion according to claim 1, wherein the component B) represents a copolymer which comprises one or more blocks A and one or more blocks X, the block A representing olefin copolymer sequences, hydrogenated polyisoprene sequences, hydrogenated copolymers of butadiene/isoprene or hydrogenated copolymers of butadiene/isoprene and styrene, and the block X representing polyacrylate-, polymethacrylate-, styrene-, α-methylstyrene or N-vinyl-heterocyclic sequences and/or sequences of mixtures of polyacrylate-, polymethacrylate-, styrene-, α-methylstyrene or N-vinyl-heterocycles.

3. The polymer dispersion according to claim 1, wherein the component B) is obtained by graft copolymerization of a monomer composition comprising (meth)acrylates and/or styrene compounds onto polyolefins according to component A).

4. The polymer dispersion according to claim 3, wherein the polymer dispersion comprises a monomer composition, comprising one or more (meth)acrylates of the formula (I)

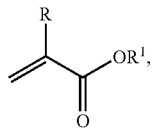

(I)

in which R denotes hydrogen or methyl and $R^1$ denotes hydrogen or a linear or branched alkyl radical having 1 to 40 carbon atoms, and/or one or more (meth)acrylates of the formula (II)

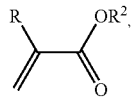

(II)

in which R denotes hydrogen or methyl and $R^2$ denotes an alkyl radical substituted by an OH group having 2 to 20 carbon atoms or denotes an alkoxylated radical of the formula (III)

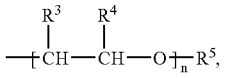

(III)

in which $R^3$ and $R^4$ independently represent hydrogen or methyl, $R^5$ represents hydrogen or an alkyl radical having 1 to 40 carbon atoms and n represents an integer from 1 to 90, and/or one or more (meth)acrylates of the formula (IV)

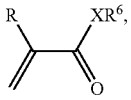

(IV)

in which R denotes hydrogen or methyl, X denotes oxygen or an amino group of the formula —NH— or —$NR^7$—, in which $R^7$ represents an alkyl radical having 1 to 40 carbon atoms, and $R^6$ denotes a linear or branched alkyl radical substituted by at least one —$NR^8R^9$ group and having 2 to 20, carbon atoms, $R^8$ and $R^9$, independently of one another, representing hydrogen, an alkyl radical having from 1 to 20, or in which $R^8$ and $R^9$, including the nitrogen atom and optionally a further nitrogen or oxygen atom, form a 5- or 6-membered ring which may optionally be substituted by $C_1$-$C_6$-alkyl.

5. The polymer dispersion according to claim 2, wherein a monomer composition which comprises dispersing monomers is used in the grafting reaction.

6. The polymer dispersion according to claim 2, wherein the weight ratio of the blocks A to the blocks X is in the range from 20:1 to 1:20.

7. The polymer dispersion according to claim 1, wherein the component A) comprises one or more olefin copolymers.

8. The polymer dispersion according to claim 1, wherein the polymer dispersion comprises from 2 to 40% by weight of component C).

9. The polymer dispersion according to claim 1, wherein the weight ratio of component C) to component D) is in the range from 2:1 to 1:25.

10. The polymer dispersion according to claim 1, wherein the polymer dispersion comprises at least 20% by weight of the component A).

11. The polymer dispersion according to claim 1, wherein the polymer dispersion comprises from 2 to 40% by weight of the components D).

12. The polymer dispersion according to claim 1, wherein the polymer dispersion comprises a compound which has a dielectric constant greater than or equal to 9.

13. The polymer dispersion according to claim 12, wherein the compound having a dielectric constant greater than or equal to 9 is selected from the group consisting of water, ethylene glycol, polyethylene glycol, alcohol and mixtures thereof.

14. The polymer dispersion according to claim 1, wherein the polymer dispersion comprises up to 30% by weight of component B).

15. A process for the preparation of polymer dispersions according to claim 1, comprising dispersing the component A) in a solution of components B) with application of shear forces at a temperature in the range from 80 to 1 80° C.

16. An additive for lubricating oil formulations comprising the polymer dispersion as claimed in claim 1.

17. A lubricating oil comprising the polymer dispersion as claimed in claim 1.

18. A method of producing a lubricating oil comprising adding the polymer dispersion as claimed in claim 1 to a lubricating oil formulation.

19. The polymer dispersion of claim 4, wherein $R^6$ denotes a linear or branched alkyl radical substituted by at least one —$NR^8R^9$ group and having 2 to 6 carbon atoms and $R^8$ and $R^9$, independently of one another, representing hydrogen, an alkyl radical having from 1 to 6 carbon atoms.

* * * * *